United States Patent [19]

Bledsoe

[11] Patent Number: 4,643,141

[45] Date of Patent: Feb. 17, 1987

[54] INTERNAL COMBUSTION ENGINE VALVE LIFT AND CAM DURATION CONTROL SYSTEM

[76] Inventor: Phillip G. Bledsoe, Rte. 1, Box 355A, Blountville, Tenn. 37617

[21] Appl. No.: 823,266

[22] Filed: Jan. 26, 1986

[51] Int. Cl.[4] ..... F01L 1/18

[52] U.S. Cl. ..... 123/90.16; 123/90.43; 123/90.44

[58] Field of Search ..... 123/90.15, 90.16, 90.27, 123/90.43, 90.44

[56] References Cited

U.S. PATENT DOCUMENTS

| | | | |
|---|---|---|---|
| 1,234,855 | 7/1917 | Barthel | 123/90.44 |
| 1,936,653 | 11/1933 | Almen | 123/90.43 |
| 2,260,983 | 10/1941 | Walker | 123/90.16 |
| 2,266,077 | 12/1941 | Roan | 123/90.16 |
| 2,412,457 | 12/1946 | Harrison | 123/90.16 |
| 2,698,611 | 1/1955 | Knudsen | 123/90.16 |
| 2,772,667 | 12/1956 | Nallinger | 123/90.43 |
| 2,997,991 | 8/1961 | Roan | 123/90.16 |
| 3,367,312 | 2/1968 | Jonsson | 123/90.16 |
| 3,413,965 | 12/1968 | Gauasso | 123/90.16 |
| 3,641,988 | 2/1972 | Tarazza et al. | 123/90.16 |

*Primary Examiner*—Ira S. Lazarus

*Attorney, Agent, or Firm*—Mason, Fenwick & Lawrence

[57] ABSTRACT

A mechanism for varying the lift, timing and duration of a valve member associated with an internal combustion engine comprising an elongated rocker arm having a first pivot end and a second end forming a valve member actuating free end, a pair of eccentric members forming a first eccentric member and a second eccentric member collectively defining a pivot axis within a circular opening for the rocker arm, the first eccentric member comprising a shaft having cylindrical end portions journaled for rotation about a shaft axis and an eccentric cylindrical portion located within the opening of the rocker arm, and the second eccentric member comprising a tubular sleeve rotatably supported on the surface of the shaft and concentric with a second eccentric axis spaced from the shaft axis, the second eccentric member rotating relative to the first eccentric member to provide a pivot axis for the rocker arm which is formed by the collective angular position of the first and second eccentric members.

19 Claims, 5 Drawing Figures

Fig-1
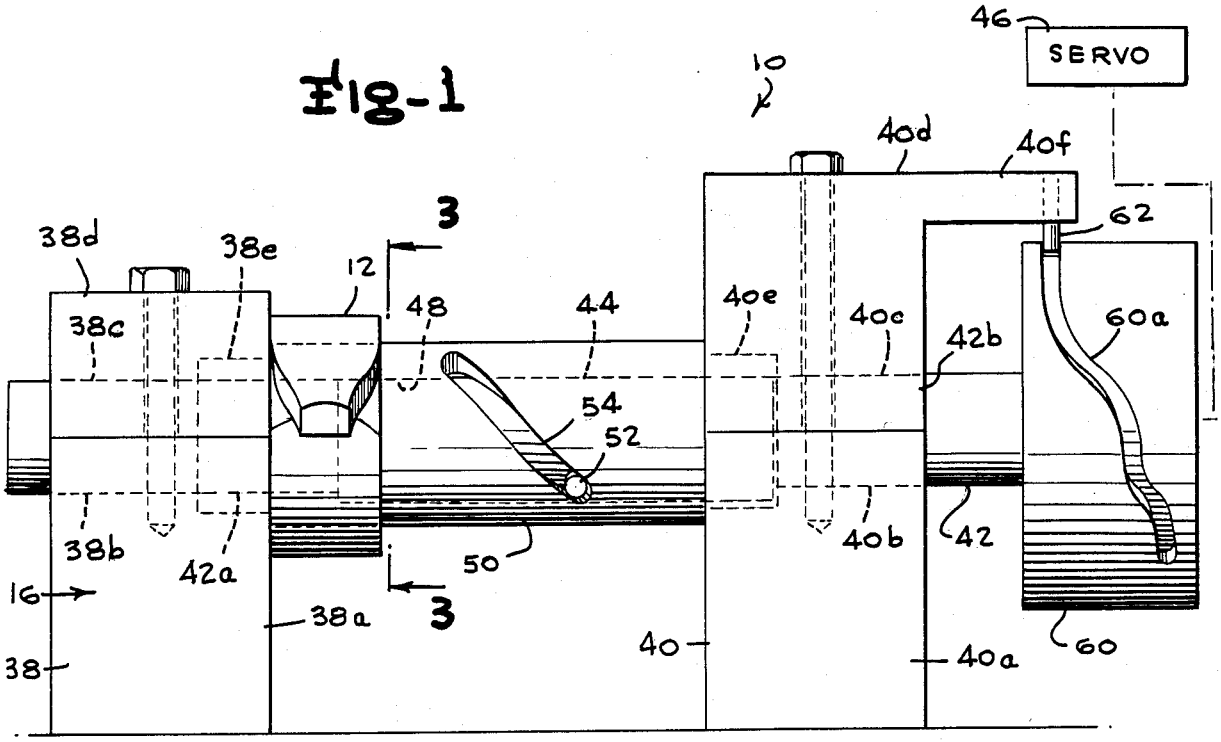
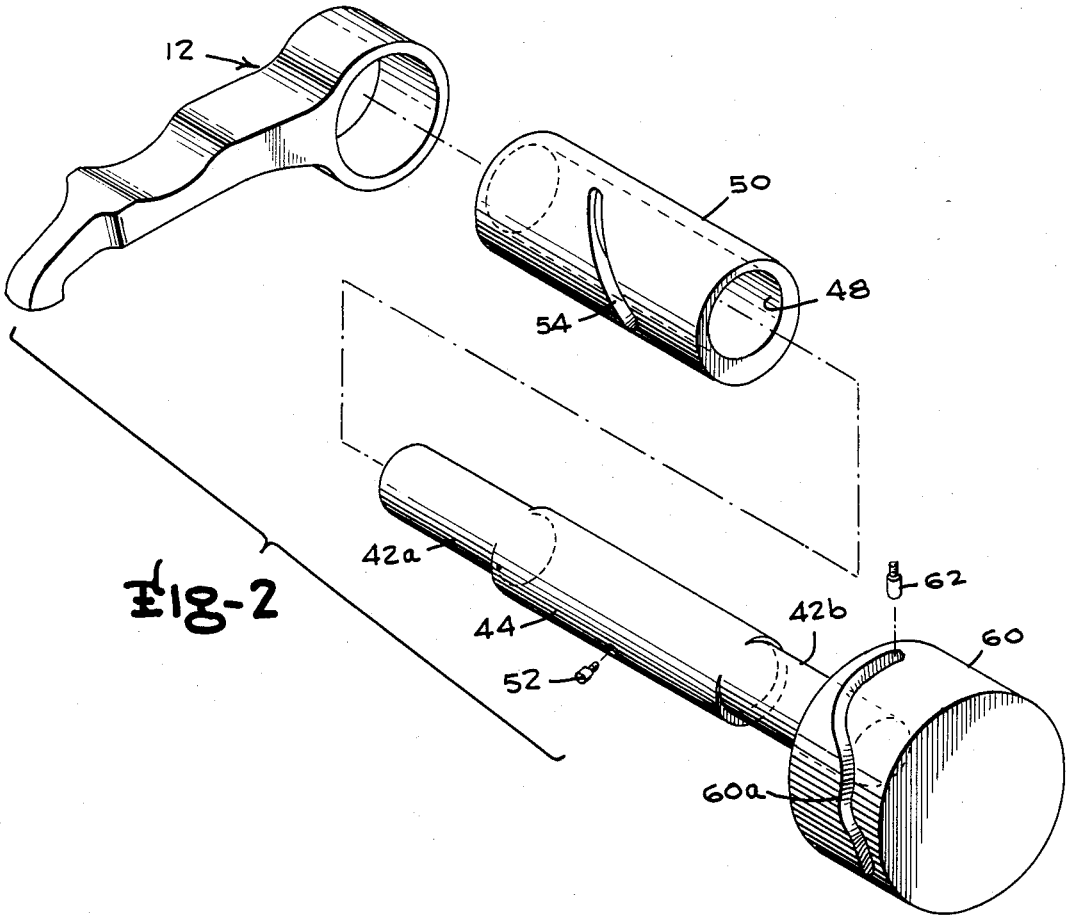
Fig-2

INTERNAL COMBUSTION ENGINE VALVE LIFT AND CAM DURATION CONTROL SYSTEM

BACKGROUND AND OBJECTS OF THE INVENTION

The present invention relates in general to valve control mechanisms for internal combustion engines, and more particularly to variable valve operating mechanisms for controlling valve timing, lift and duration in internal combustion engines.

Heretofore, many overhead valve and overhead cam mechanisms have been provided for operating the valves of internal combustion engines to control the opening and closing of the inlet and exhaust valves. In a more or less typical overhead valve and overhead cam layout, the valves are each operated by an associated rocker arm in a set and unvariable fashion. Adjustment of these, for the most part, has been to control the height of valve opening, usually referred to as the valve lift. Other mechanisms have been proposed for controlling the period or duration of valve opening without varying the valve lift.

A patent which typically depicts a mechanism for adjusting only the valve lift is U.S. Pat. No. 1,395,851 to F. B. McLean, wherein the lever or moment arm for opening of the valve is derived from a rocker arm that is pivotedly mounted intermediate its ends, and wherein the pivot point or fulcrum is shiftable to vary the amount of valve lift produced by the valve cam.

Another patent showing a mechanism that determines both the amount of valve lift and the time that the valve remains open is U.S. Pat. No. 2,412,457 to L. D. Harrison. This mechanism employs a profiled or specifically contoured adjusting rocker arm or lever that is shifted relative to the valve to be opened and closed. In this mechanism, the control of the lift and duration are integrated with each other and one cannot be realized in practice without affecting the other. The predominate change in this mechanism is in the duration, with the change in lift being very slight.

A number of U.S. patents have been more recently granted in the name of C. O. Burandt for various variable valve operating mechanisms involving two lever members for each valve. These include U.S. Pat. No. 4,414,931 granted Nov. 15, 1983, U.S. Pat. No. 4,459,946 granted July 17, 1984 and U.S. Pat. No. 4,484,546 granted Nov. 27, 1984.

Another prior patent involving a two lever control for each valve is U.S. Pat. No. 4,438,736 to Hara et al.

An object of the present invention is the provision of a variable valve operating mechanism involving a single rocker arm for each valve with a mechanism for positioning the rocker arm involving a pair of eccentrics to effect simultaneous change of valve lift and cam duration. My mechanism provides means to change valve timing, lift and duration by providing an eccentric shaft which is interrelated with an eccentric bushing so as to move the rocker arm for the associated valve in such manner as to change the leverage ratio or lift, and which changes valve timing by variation in the angle at which the cam contacts the rocker arm and varies the duration because of the shape of the rocker arm surface contacted by the cam.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 1 is a somewhat diagrammatic elevational view of the variable valve operating mechanism of the present invention, showing the essential mechanical components supported in a bearing pedestal fixture for demonstration purposes;

FIG. 2 is an exploded perspective view of the valve actuating rocker arm and position controlling components of the variable valve operating mechanism, omitting the components of the bearing pedestal;

DETAILED DESCRIPTION OF A PREFERRED EMBODIMENT

Figure 3:
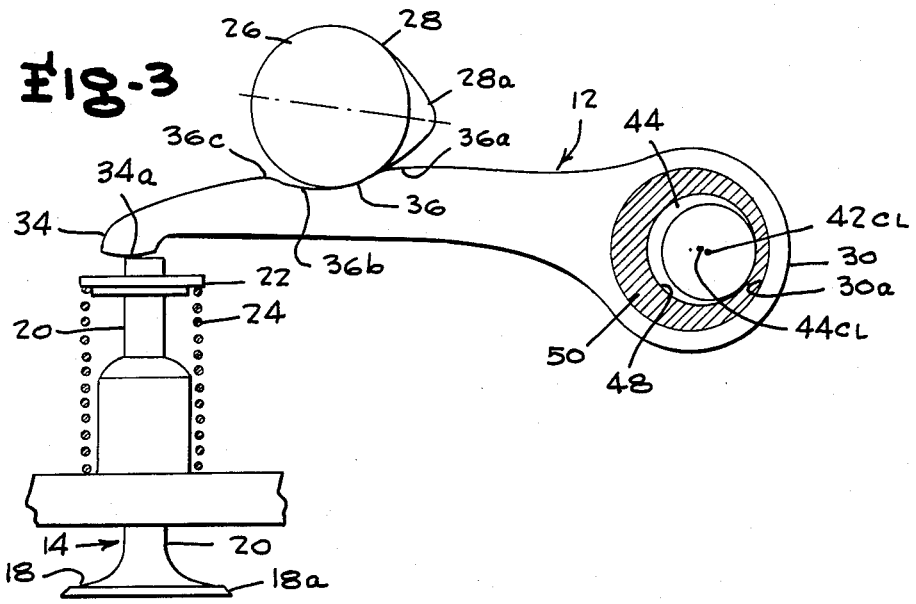
FIG. 3 is a somewhat diagrammatic sectional view taken along the line 3—3 of FIG. 1, showing the rocker arm positioned relative to the valve stem of the associated valve, with the rocker arm in its farthest projected position to the left relative to the center axis of the valve stem.

Referring to the drawings, wherein like referenced characters designate corresponding parts throughout the several figures, there is shown in FIG. 1 a demonstration assembly, generally indicated by the reference character 10, of a single valve control rocker arm, indicated generally at 12, for a single valve 14, of an internal combustion engine, together with the variable valve operating mechanism of the present invention, supported in a demonstration bearing pedestal assembly indicated generally by the reference character 16. It will be appreciated that the mechanism is designed for use with a conventional internal combustion engine (not shown) which includes the usual cylinder blocks containing a combustion chamber, with a cylinder head overlying the cylinder block and secured thereto, containing the usual valve ports controlled by valves such as the valve 14. The valve 14 conventionally includes a valve head 18 which is beveled as indicated at **18*a* so as to seat against the conventional beveled seat of the associated valve port. Extending upwardly from the valve head 18 is a vertically elongated generally cylindrical stem 20, provided adjacent the upper end portion thereof with suitable means, such as an annular groove, for anchoring a washer-like annular retainer washer or the like 22, the valve stem 20 being surrounded by a coil spring 24 which acts against the retainer washing 22 to normally close the valve 14**.

A cam shaft 26, which is driven from the engine, has a conventional valve cam 28, having an appropriately contoured lobe **28*a*. It will be appreciated that the cam shaft 26 has a number of cams 28** thereon, depending upon the number of cylinders or combustion chambers present in the engine, to provide control for the intake valve ports as well as exhaust valve ports. The system of the present invention is obviously suitable for control of both inlet and exhaust valves.

It will be seen from the drawings that the rocker arm 12 includes an enlarged generally circular pivot end portion 30 having a circular opening 30*a* therein, an elongated intermediate arm portion 32, and a valve actuating formation or protrusion 34*a* at the opposite free end 34 of long radius convex configuration in the illustrated embodiment. A shaped generally concave upwardly facing cam follower surface formation 36 is located intermediate the shaped convex valve stem actuating formation 34*a* and the generally circular enlarged pivot end portion 30 as shown.

Referring particularly to FIG. 1, the demonstration assembly 10 includes two sectionalized upright bearing pedestal formations 38 and 40 mounted on a base by appropriate bolts or similar fasteners. Each of the upright bearing pedestal formations 38 and 40 include a lower pedestal section 38*a*, 40*a* each having an upwardly facing concave cylindrical recess 38*b*, 40*b* complementing similar downwardly facing concave recesses 38*c*, 40*c* in the cap or upper section portions 38*d*, 40*d* of the pedestals 38 and 40. The complementing concave semi-cylindrical facing or confronting recesses 38*b*, 38*c* and 40*b*, 40*c* provide bearings for the cylindrical shaft member 42 forming what is termed the "eccentric shaft" of the control mechanism, but which includes cylindrical end portions 42*a*, 42*b* in the pedestal sections and a cylindrical eccentric formation 44 integral with the cylindrical shaft 42 defined by the end portions 42*a*, 42*b* but arranged with its center line 44-*cl* spaced eccentrically from the center line 42-*cl* of the cylindrical shaft portion 42 defined by the end portions 42*a*, 42*b*.

The first cylindrical eccentric formation 44 on the shaft 42, when it is turned about its axis by a servo, for example indicated at 46, which responds to the requirements of the engine, causing rotation of the shaft 42 and thus eccentric cylindrical formation 44 causes the rocker arm 12 to move toward or away from the valve. The eccentric cylindrical formation 44 is, in turn, rotatably journaled in a cylindrical bore 48 provided in a tubular cylindrical eccentric bushing or sleeve 50 which is captured within the space between the confronting surfaces of the bearing pedestal assemblies 38 and 40 to prevent axial movement thereof and which is rotatable in the cylindrical opening 30*a* of the pivot end portion 30 of the rocker arm and has an outer diameter matched to the inner diameter of the cylindrical opening 30*a* for rotation of the eccentric bushing therein. As will be apparent from inspection of FIGS. 3, 4 and 5, as the shaft 42 and first cylindrical eccentric formation 44 is turned, while the eccentric bushing or sleeve 50 remains within the rocker arm opening 30*a* forming the journal bearing therefor, the rocker arm will move, for example, toward the left from the FIG. 5 position to the FIG. 4 position and then to the FIG. 3 position.

The shaft 42 supporting the eccentric cylindrical formation 44 thereon, in addition to being rotatable, is also movable axially within the bearings therefor formed by the bearing pedestals 38, 40, causing a pin 52 projecting radially from the surface of the eccentric cylindrical formation 44 generally in the mid region thereof to track in the helical or spiral slot 54 provided in the cylindrical bushing or sleeve 50, causing rotation of the eccentric bushing or sleeve 50 forming the second eccentric of the system to different angular positions in addition to the different angular positions formed by rotation of the shaft 42 and its eccentric formation 44 within the cylindrical bore of the second eccentric 50. Thus, compound action is produced causing a change in the position of the center line or pivot axis 56 of the circular opening 30*a* in the pivot end 30 of the rocker arm, providing a very large number of possible locations for this center pivot axis 56 by controlling the rotation of the eccentric bushing member 50 and the eccentric formation 44 on the shaft 42.

It will be noted from FIG. 1 that counterbores or recesses indicated at 38*e* and 40*e* are provided in the end portions of the pedestals 38 and 40 nearest the eccentric bushing or sleeve 50, for the purpose of accommodating the adjacent ends of the eccentric cylindrical formation 44 integral with and on the shaft 42 as the shaft 42 slides axially to the left or to the right. For example, as shown in FIG. 1, the shaft 42 is at its right hand limit position and the right hand end portion of the cylindrical eccentric formation 42 is located within the counterbore formation 40*e* in this position. As the shaft 42 is moved axially from this right hand limit position, the movement of the pin 52 in the angled slot 54 of the eccentric bushing 50 causes the bushing 50 to rotate around the already eccentric portion 44 of the shaft 42 in accordance with a predetermined pattern, to effect the desired change in lift, timing and duration at the various fore-and-aft positions which the rocker arm may assume to place the proper portions of the shaped cam follower recess surface 36 in contact with the lobe 28*a* of the cam shaft 26 at the proper time.

In one embodiment, the control of the angular position of the eccentric bushing 50 in coordination with rotation of the shaft 42 supporting the eccentric formation 44 is achieved by a drum cam 60 having a shaped cam slot 60*a* therein receiving a pin 62 projecting downwardly from the extension arm 40*f* of the bearing pedestal formation 40. In this manner, controlled axial movement of the shaft 42 and its eccentric formation 44 during rotation of the shaft 42 by the automobile servo 46 effects a coordinated angular adjustment of the position of the eccentric bushing 50 through axial movement of the pin 52 tracking in the inclined slot 54. The movement of the eccentric bushing 50 caused by the pin 52 and slot 54 to correct for the defect in the clearance at the cam and cause proper positioning of portions of the cam follower recess 36 relative to the cam 28 which would occur if the eccentric bushing 50 alone were moved to cause the center or pivot axis of the rocker arm to move toward or away from the valve and the arc which would be produced by angular adjustment of the eccentric bushing 50.

Figure 4:
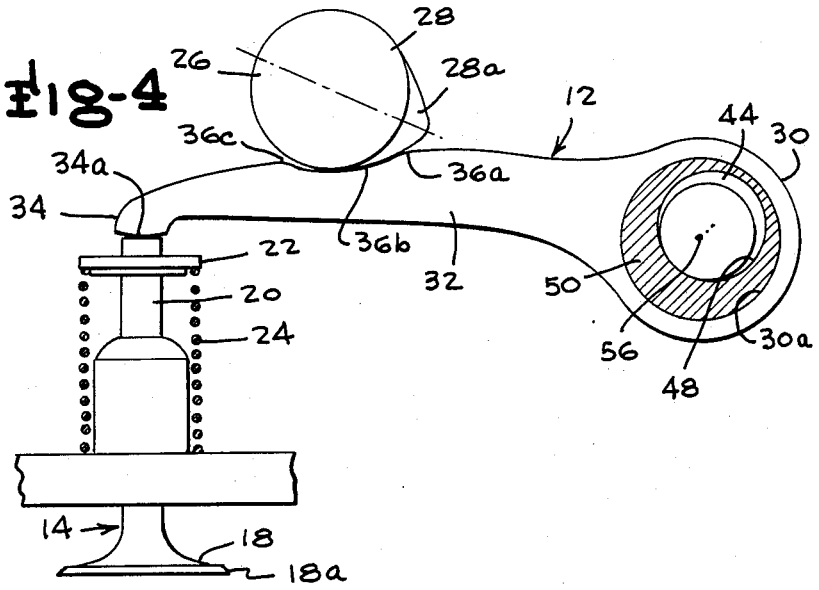
FIG. 4 is a somewhat diagrammatic sectional view similar to FIG. 3, but showing the rocker arm contoured valve stem contacting portion approximately centered relative to the axis of the valve stem.
Figure 5:
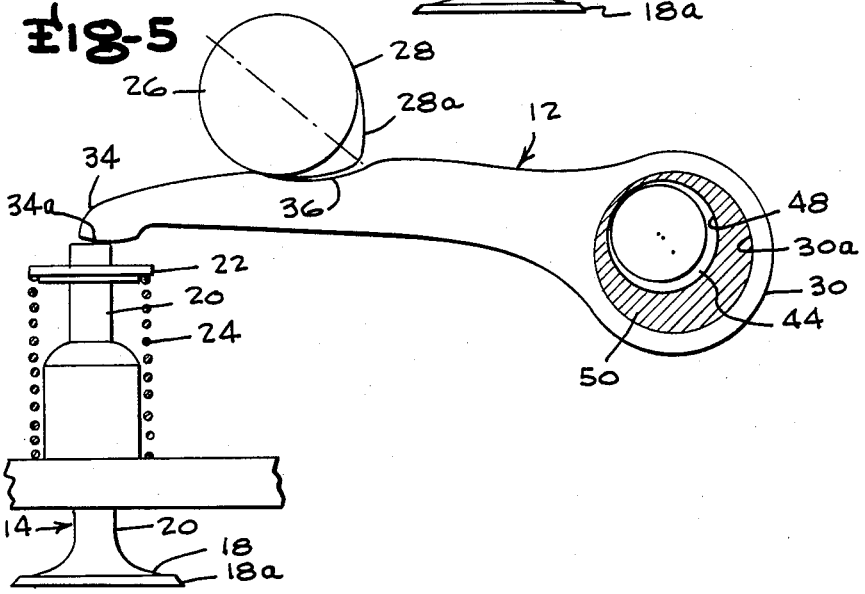
FIG. 5 is a somewhat diagrammatic sectional view similar to FIGS. 3 and 4, but showing the rocker arm at an adjusted position substantially furtherest to the right in its range of adjusted positions.

It will be noted from FIGS. 3, 4 and 5 that the right hand end of the shaped cam follower recess surface 36, from the end of the recess, indicated at 36*a*, nearest the pivot end 30 of the rocker arm to an intermediate portion thereof, indicated generally at 36*b*, is a shaped upwardly concave surface while the remainder of the surface portion from the zone 36*b* to the end 36*c* thereof nearest the valve engaging end 34 of the rocker arm is somewhat convex. The shaping of this contoured cam follower recess surface 36 is designed, in cooperation with fore-and-aft or in-and-out movement of the rocker arm relative to the stem 20 of the valve 18 caused by displacement of the pivot axis 56 toward or away from the valve, and movement of the pivot axis 56 up or down from the position shown in FIG. 3 by coordinated combinations of movement of the eccentrics 44 and 50, to achieve the desired changing of lift, timing and valve opening duration. For example, if the rocker arm 12 is moved all the way to the left as viewed in FIG. 3, the lobe 28*a* of cam 28 engages the concave end portion of the recess 36 near the inner end 36*a* thereof to begin to lift the valve at an earlier time than would be the case if the rocker arm 12 were shifted or retracted toward the pivot axis 56 to the substantially middle location of FIG. 4 or the right hand or retracted limit position of FIG. 5, where the lobe 28*a* of the cam 28 of cam shaft 26 engages the contoured surface 36 at later relative times causing the timing of the beginning of valve lifting to occur later. Combinations of change of position of this pivot axis 56 formed by changing of the center lines 44*cl* and 42*cl* of the eccentric bushing 44 and eccentric formation 42 on shaft 40 effect a substantially infinite number of variations of timing, distance of valve lifting, and valve lift duration.

I claim:

1. A mechanism for varying the lift, timing and duration of a valve member associated with an internal combustion engine having a camshaft, a cam on said camshaft, and a rectilinear reciprocatable valve member for opening and closing a valve port in communication with a combustion chamber of the engine; the mechanism comprising an elongated rocker arm having a first pivot end and a second end forming a valve member actuating free end and an intermediate portion extending therebetween, said free end having a shaped valve member contact formation projecting therefrom and said pivot end having a circular opening therethrough receiving a pivotal mounting assembly therethrough having an exterior cylindrical surface within and corresponding substantially to the diameter of said circular opening forming the surface about which the rocker arm pivots, a pair of eccentric means forming a first eccentric member and a second eccentric member collectively defining a pivot axis within said circular opening for said rocker arm, said first eccentric member comprising a shaft having cylindrical end portions journaled for rotation about a shaft axis and an eccentric cylindrical portion located within said opening of said rocker arm, the eccentric cylindrical portion being concentric with a first eccentric axis spaced from said shaft axis, and said second eccentric member comprising a tubular sleeve defining said exterior cylindrical surface and having a cylindrical bore having an inner diameter corresponding to said eccentric cylindrical portion of said shaft rotatably supported on the surface of the latter and concentric with a second eccentric axis spaced from said shaft axis and said first eccentric axis, a first means for rotating said shaft, and second means for rotating said second eccentric member relative to the first eccentric member of said shaft to provide a pivot axis for said rocker arm which is formed by the collective angular position of said first and second eccentric members.

2. A mechanism as defined in claim 1, wherein said cam on said camshaft has a cylindrical portion over part of its circumference and a projecting lobe protruding from the cylindrical path of said cylindrical portion, and said rocker arm has a contoured cam follower recess along an upwardly facing portion of said intermediate portion to be engaged by the cylindrical and lobe portions of said cam.

3. A mechanism as defined in claim 1, wherein said cam on said camshaft has a cylindrical portion over part of its circumference and a projecting lobe protruding from the cylindrical path of said cylindrical portion, and said rocker arm has a contoured cam follower recess along an upwardly facing portion of said intermediate portion to be engaged by the cylindrical and lobe portions of said cam, said cam follower recess having longitudinally spaced portions to be engaged by the lobe of said cam in accordance with variable longitudinal positions of the rocker arm determined by the relative angular position of said first and second eccentric members to vary the lift, timing and duration of said valve member.

4. A mechanism as defined in claim 1, wherein said cam on said camshaft has a cylindrical portion over part of its circumference and a projecting lobe protruding from the cylindrical path of said cylindrical portion, and said rocker arm has a contoured cam follower recess along an upwardly facing portion of said intermediate portion to be engaged by the cylindrical and lobe portions of said cam, said cam follower recess having longitudinally spaced convex and concave shaped portions to be engaged by the lobe of said cam in accordance with variable longitudinal positions of the rocker arm determined by the relative angular position of said first and second eccentric members to vary the lift, timing and duration of said valve member.

5. A mechanism as defined in claim 1, wherein said valve member actuating free end of said rocker arm is a downwardly projection nose formation having a downwardly convex valve member engaging surface defining a downwardmost center portion and first and second opposite end portions located in upwardly spaced relation to said center portion, said pair of eccentric means being rotatably positionable to selectively dispose said center portion or either of said opposite end portions to engage said valve member.

6. A mechanism as defined in claim 2, wherein said valve member actuating free end of said rocker arm is a downwardly projection nose formation having a downwardly convex valve member engaging surface defining a downwardmost center portion and first and second opposite end portions located in upwardly spaced relation to said center portion, said pair of eccentric means being rotatably positionable to selectively dispose said center portion or either of said opposite end portions to engage said valve member.

7. A mechanism as defined in claim 3, wherein said valve member actuating free end of said rocker arm is a downwardly projection nose formation having a downwardly convex valve member engaging surface defining a downwardmost center portion and first and second opposite end portions located in upwardly spaced relation to said center portion, said pair of eccentric means being rotatably positionable to selectively dispose said center portion or either of said opposite end portions to engage said valve member.

8. A mechanism as defined in claim 1, wherein said second means for rotating said eccentric member relative to the first eccentric member comprises an inclined slot through said second eccentric member and a drive pin member in said first eccentric member protruding from the surface of said eccentric surface of said first eccentric member into said inclined slot to rotatably drive the second eccentric member to different angular position upon axial movement of the first eccentric member, and means for axially moving the first eccentric member to different positions.

9. A mechanism as defined in claim 2, wherein said second means for rotating said eccentric member relative to the first eccentric member comprises an inclined slot through said second eccentric member and a drive pin member in said first eccentric member protruding from the surface of said eccentric surface of said first eccentric member into said inclined slot to rotatably drive the second eccentric member to different angular position upon axial movement of the first eccentric member, and means for axially moving the first eccentric member to different positions.

10. A mechanism as defined in claim 3, wherein said second means for rotating said eccentric member relative to the first eccentric member comprises an inclined slot through said second eccentric member and a drive pin member in said first eccentric member protruding from the surface of said eccentric surface of said first eccentric member into said inclined slot to rotatably drive the second eccentric member to different angular position upon axial movement of the first eccentric member, and means for axially moving the first eccentric member to different positions.

11. A mechanism as defined in claim 4, wherein said second means for rotating said eccentric member relative to the first eccentric member comprises an inclined slot through said second eccentric member and a drive pin member in said first eccentric member protruding from the surface of said eccentric surface of said first eccentric member into said inclined slot to rotatably drive the second eccentric member to different angular position upon axial movement of the first eccentric member, and means for axially moving the first eccentric member to different positions.

12. A mechanism as defined in claim 5, wherein said second means for rotating said eccentric member relative to the first eccentric member comprises an inclined slot through said second eccentric member and a drive pin member in said first eccentric member protruding from the surface of said eccentric surface of said first eccentric member into said inclined slot to rotatably drive the second eccentric member to different angular position upon axial movement of the first eccentric member, and means for axially moving the first eccentric member to different positions.

13. A mechanism as defined in claim 6, wherein said second means for rotating said eccentric member relative to the first eccentric member comprises an inclined slot through said second eccentric member and a drive pin member in said first eccentric member protruding from the surface of said eccentric surface of said first eccentric member into said inclined slot to rotatably drive the second eccentric member to different angular position upon axial movement of the first eccentric member, and means for axially moving the first eccentric member to different positions.

14. A mechanism as defined in claim 8, wherein said last mentioned means is a drum cam fixed to said first eccentric member for moving the latter to selected angular and axial positions upon rotation of the drum cam and first eccentric member.

15. A mechanism as defined in claim 9, wherein said last mentioned means is a drum cam fixed to said first eccentric member for moving the latter to selected angular and axial positions upon rotation of the drum cam and first eccentric member.

16. A mechanism as defined in claim 10, wherein said last mentioned means is a drum cam fixed to said first eccentric member for moving the latter to selected angular and axial positions upon rotation of the drum cam and first eccentric member.

17. A mechanism as defined in claim 11, wherein said last mentioned means is a drum cam fixed to said first eccentric member for moving the latter to selected angular and axial positions upon rotation of the drum cam and first eccentric member.

18. A mechanism as defined in claim 12, wherein said last mentioned means is a drum cam fixed to said first eccentric member for moving the latter to selected angular and axial positions upon rotation of the drum cam and first eccentric member.

19. A mechanism as defined in claim 13, wherein said last mentioned means is a drum cam fixed to said first eccentric member for moving the latter to selected angular and axial positions upon rotation of the drum cam and first eccentric member.

* * * * *